United States Patent [19]

Scalf

[11] Patent Number: 4,805,970

[45] Date of Patent: Feb. 21, 1989

[54] DRAWER STOP

[75] Inventor: Matt C. Scalf, High Point, N.C.

[73] Assignee: Armstrong World Industries, Inc., Lancaster, Pa.

[21] Appl. No.: 179,421

[22] Filed: Apr. 8, 1988

[51] Int. Cl.[4] ..... A47B 88/00

[52] U.S. Cl. ..... 312/348; 312/330 R

[58] Field of Search ..... 312/348, 330 R; 292/DIG. 38, 78, DIG. 7, DIG. 15, DIG. 4

[56] References Cited

U.S. PATENT DOCUMENTS

| | | | |
|---|---|---|---|
| 493,112 | 3/1893 | Patten | 292/DIG. 15 X |
| 1,870,553 | 8/1932 | Bullen | 312/348 X |
| 2,340,762 | 2/1944 | Lundin | 312/348 X |
| 2,479,626 | 8/1949 | Klein | 312/348 |
| 2,664,334 | 12/1953 | Bissman | 312/348 X |
| 3,647,271 | 3/1972 | Allred | 312/348 X |
| 3,658,394 | 4/1972 | Gutner | 312/348 X |

*Primary Examiner*—Peter A. Aschenbrenner

*Assistant Examiner*—Thomas A. Rendos

[57] ABSTRACT

A dovetail drawer guide wherein the mortise member is attached to the outer bottom surface of a drawer and the tenon member is mounted on base frame adjacent the bottom of the drawer slideway of the case goods, further includes a pivotal drawer stop means mounted on one side of the mortise member. The stop means includes a body portion having an arcuate edge, a resilient finger member, and a leg member opposite the arcuate edge. The stop means pivots such that the leg member is out of the path of movement when the drawer is inserted in the slideway, but the leg drops by gravity to engage the forward base plate and prevent the drawer being pulled out of the slideway during normal use. The stop means is of sufficient resilience to permit overriding thereof by application of force, which force compresses both the finger and leg members, to permit removal of the drawer from the slideway.

5 Claims, 2 Drawing Sheets

DRAWER STOP

BACKGROUND AND SUMMARY OF THE PRESENT INVENTION

In case goods of superior quality, and particularly in reproductions of antiques, there is a preference to utilize construction techniques which as closely as possible resemble those utilized by early cabinet makers in constructing the originals. It is also desirable to accomplish this goal without sacrificing the advantages of newer technology. Where these reproductions are of case goods such as dressers and cabinets having drawers therein, manufacturers are returning to the use of wooden, dovetail drawer guides for authenticity. The use of such drawer guides, however, has led to a need for a drawer stop means which does not detract from the structural authenticity of the piece. Conventional, or contemporarily known drawer guides or stops are largely made, in their entirety, from metal and/or plastic, and thereby generally are unacceptable in higher quality reproduction furniture. It was thus an objective of the present invention to develop a drawer stop means which would be acceptable for use in antique reproductions, would have minimal components, and would be applicable to simple, dovetail drawer guides.

The present invention accomplishes these objectives and is an improved stop means for use with dovetail drawer guides; which stop, although made from a polymeric material, does not unnecessarily detract from the authenticity of the reproduction. The present stop means is a primarily rigid but somewhat resilient, pivotally mounted device that is mounted on the side of the upper guide member of a dovetail drawer guide. The upper guide member of the drawer guide includes a mortise cut out of its lower surface, and is mounted on the outer bottom surface of a drawer with the open mortise facing downwardly. The lower guide member of the drawer guide is a mating dovetail shaped tenon attached to the upper surface of front and rear base plates which form the bottom of the drawer slideway in the case goods. When the drawer is inserted in the slideway the tenon is slidably retained in the mortise to guide the drawer in and out of the slideway.

The improved stop means is pivotally mounted on one outer side of the guide member, toward the rear of the drawer. The stop includes a substantially flat body portion having an arcuate side and a leg member integral to the body and positioned substantially opposite the arcuate edge. When the drawer is inserted into the slideway the leg portion pivots freely out of the path of the base plates to permit free movement of the drawer into the case goods. After passing over the forward base plate the stop mechanism pivots by gravity to a position where the leg member depends downwardly behind the forward base plate. When the drawer is pulled outwardly, under normal use, the substantially rigid leg engages the base plate and stops the drawer. The arcuate upper surface on the stop means abuts the undersurface of the drawer and prevents full rotation of the stop when the drawer is pulled forward, thus preventing the backward pivoting of the leg member.

The stop means is formed of a substantially rigid, but slightly resilient material such as urethane and is so shaped as to include an upper resilient finger. The slight resiliency provided by the urethane finger allows the finger to flex and the distance between the leg member and the finger to be compressed. Thus the normal locking pressure is overridden by application of force when it is desirable to fully remove the drawer from the slideway. However, under normal use the leg will engage and lock against the base plate and inhibit removal of the drawer.

DETAILED DESCRIPTION OF A PREFERRED EMBODIMENT

Figure 4A:
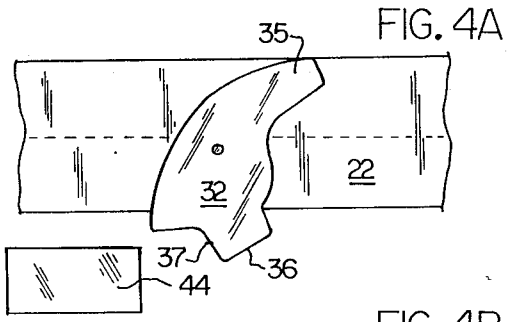
FIGS. 4A and 4C are schematic illustrations showing the stop member in the non-engaged, locked, and flexed positions respectively.

A drawer guide 10 for a drawer D is utilized to guide the drawer in and out of a slideway in the cabinet or case goods C. The guide 10 is a dovetail member, preferably of wood, and including an upper drawer guide 12 mounted on the bottom of the drawer, and a lower drawer guide 14 mounted in the case goods. The upper member 12 includes a dovetail mortise 20 cut therethrough and outer sidewalls 22. The lower member 14 is in the form of a dovetail tenon which fits in sliding relationship within mortise 20.

A stop means 30 is pivotally mounted on one outer side 22 of the upper guide 12. The stop means 30 includes a body portion 32 having one arcuate side 34, a resilient upper finger 35 of reduced cross section and an integral depending leg member 36 positioned somewhat opposite the arcuate side. Leg 36 forms a wall or locking edge 37 which engages the base plate 44 as the drawer reaches its fully open position. The front surface 33 of the stop member 30 is immaterial so long as it is curved in some configuration to cause the leg 36 to pivot upwardly as the drawer is initially inserted.

Figure 4B:
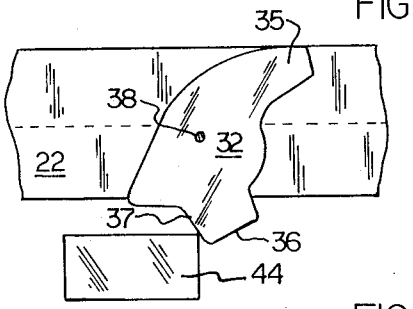

The stop means 30 is pivotally mounted on the upper drawer guide 12 by a pivot pin, or other similar conventional means, through an aperture at pivot point 38. The pivot point 38 is above the center of gravity of the stop member so that the leg 36 is suspended as shown in FIG. 4B to engage base plate 44. The maximum vertical dimension of stop member 30 (between leg 36 and arcuate side 34 is slightly greater than the corresponding distance between the base plate and the bottom surface of the drawer.

The drawer D is inserted in a slideway defined by the frame of the case goods and including: sidewalls 40 of the frame; an optional bottom wall 42 which underlies the bottom of the drawer when the drawer is inserted into the slideway; a front base plate 44 and a rear base plate 46 (not shown). The dovetail tenon or lower guide 14 is mounted on the upper surfaces of the base plates 44, 46.

Figure 1:
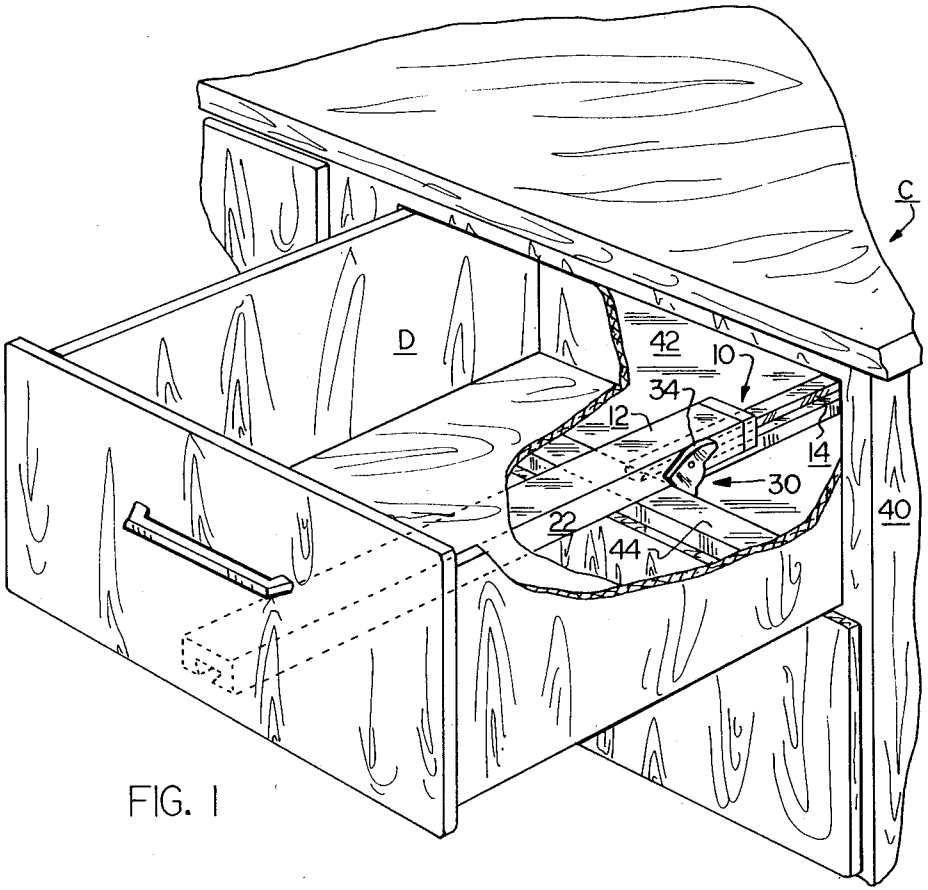
FIG. 1 is a perspective view, with parts broken away, of the drawer partially inserted in the slideway of the supporting case goods.
Figure 2:
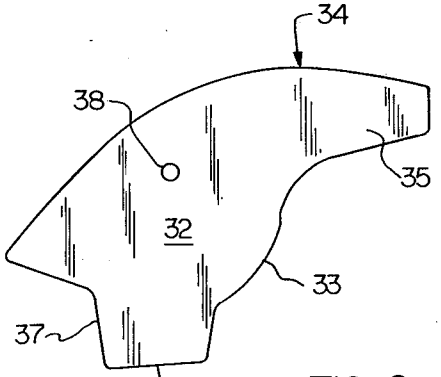
FIG. 2 is a profile view of the stop mechanism.

When the drawer is inserted in the slideway and the drawer guides 12 and 14 cooperatively engaged, the leg 36 of the stop means pivots upwardly toward the front of the drawer (FIG. 1) as it passes over the base plate 44. When beyond the base plate, the stop means pivots by gravity back to the normal position (FIG. 4A) wherein the leg 36 depends downwardly, extending somewhat below the surface of the base plate also.

As the drawer is pulled out of the slideway, under normal use, the downwardly extending leg 36 strikes the back of the base plate 44 (FIG. 4B) and prevents the drawer from being pulled completely out of the slideway. The oppositely positioned arcuate edge 34 contacts the underside of the drawer and prevents the pivoting of leg 36 backwardly to clear the base plate.

Figure 4C:
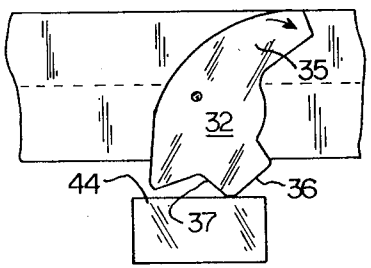

However, when it is desirable to remove the drawer from the slideway, application of force forwardly against the base plate 44 causes the finger 35 to flex (FIG. 4C). The distance between leg 36 and finger 35 is thereby decreased to the extent that leg 36 cams across the front base plate 44 and the drawer is released.

Figure 3:
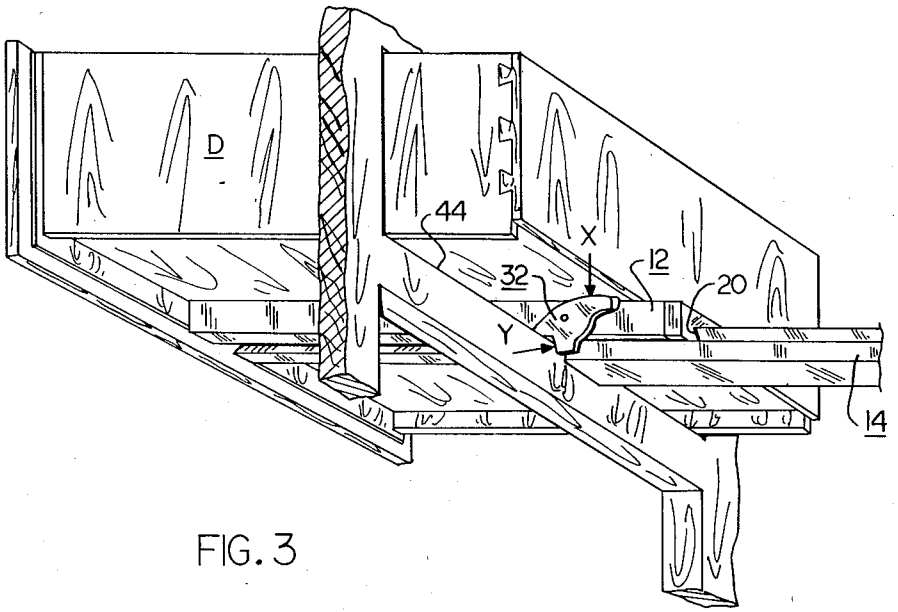
FIG. 3 is a perspective view taken from the rear of the drawer illustrating the engagement of the stop means against the case goods.

FIG. 3 illustrates this compression at the points denoted by arrows "x" and "y". The preferred material for the stop means is a urethane of a durometer of approximately 75 on an "A" scale. Such a urethane is sufficiently rigid to permit the stop means 30 to hold against the plate 44 under normal use, but to compress under application of force to remove the drawer. It is also to be understood that other materials and polymers might be utilized for the stop means and/or the drawer guide. The description above is of a preferred embodiment and not intended as a limitation. The invention is limited only by the scope of the claims below.

What is claimed is:

1. A drawer stop means for use in case goods wherein the frame of the case goods defines a drawer slideway having front and rear base plates spaced below and underlying the bottom wall of the drawer when the drawer is inserted in the slideway; and wherein a first, elongated upper drawer guide is attached to the undersurface of the drawer, and a second elongated lower drawer guide is attached to the upper surface of the base plates; and said first and second drawer guides are slidably engaged to guide the drawer as it is moved in and out of said slideway; the improvement wherein said stop means including:

a. a body portion having an upper, resilient finger means and a lower, depending leg member;

b. said body portion being pivotally attached to a side of said first, upper drawer guide such that said stop means is pivotally movable between a first release position wherein said stop means pivots in a first arcuate direction and passes over said front base plate when said drawer is inserted and moved along said slideway in one direction, and a second normal position wherein said leg member will engage said front base plate to impede movement of the drawer as said drawer is pulled along said slideway in an opposite direction and said finger rests against the undersurface of said drawer;

c. said body portion having an overall vertical dimension when in said second normal position greater than the vertical distance between the undersurface of said drawer and said front base plate whereby said stop means cannot bypass said front base plate without engagement thereof;

d. means for causing said stop means to normally be oriented in said second normal position; and e. said finger means being so shaped and formed of such material as to flex responsive to application of additional force in said opposite direction on the drawer, thereby overriding said engagement of said leg member against said front base plate and permitting said leg to pass over said base plate.

2. A drawer stop means according to claim 1 wherein said means for causing said stop means to normally be retained in said first normal position comprises the pivotal attachment of said body portion to said upper drawer guide in such a manner that said leg member and the center of gravity of said stop means are below the pivot point thereof.

3. A stop means according to claim 1 wherein said stop means is formed from a polymeric material of a type having a characteristic rigidity but including resilence sufficient to allow said finger to flex under application of a prescribed degree of force.

4. An improved drawer guide and stop means according to claim 3 wherein said polymeric material is urethane having a characteristic hardness of 75 durometer.

5. A stop means according to claim 1 wherein said body portion between said upper finger and said lower leg has a configuration so shaped as to permit said stop means a pivot in said first arcuate direction to pass over said front base plate when the drawer is inserted in said slideway.

* * * * *